US012227994B2

(12) United States Patent
Webb et al.

(10) Patent No.: US 12,227,994 B2
(45) Date of Patent: Feb. 18, 2025

(54) CUTTING ELEMENTS AND GEOMETRIES, EARTH-BORING TOOLS, AND RELATED METHODS

(71) Applicant: Baker Hughes Oilfield Operations LLC, Houston, TX (US)

(72) Inventors: Timothy C. Webb, Midland, TX (US); Zachary Borders, Midland, TX (US); Stephen Duffy, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 298 days.

(21) Appl. No.: 17/646,421

(22) Filed: Dec. 29, 2021

(65) Prior Publication Data

US 2023/0203892 A1 Jun. 29, 2023

(51) Int. Cl.
*E21B 10/567* (2006.01)
*E21B 10/42* (2006.01)
*E21B 10/633* (2006.01)

(52) U.S. Cl.
CPC ..... *E21B 10/5673* (2013.01); *E21B 10/42* (2013.01); *E21B 10/633* (2013.01)

(58) Field of Classification Search
CPC ..... E21B 10/5673
See application file for complete search history.

(56) References Cited

U.S. PATENT DOCUMENTS 4,109,737 A 8/1978 Bovenkerk
4,877,096 A * 10/1989 Tibbitts ..... E21B 10/573 175/432
5,333,699 A 8/1994 Thigpen et al.
5,437,343 A 8/1995 Cooley et al.
5,499,688 A 3/1996 Dennis
6,196,340 B1 3/2001 Jensen et al.
(Continued)

FOREIGN PATENT DOCUMENTS

CN 210460513 5/2020
CN 214498921 U 10/2021
(Continued)

OTHER PUBLICATIONS

International Search Report for Application No. PCT/US2022/080536 dated Mar. 13, 2023, 4 pages.
(Continued)

*Primary Examiner* — Blake Michener
(74) *Attorney, Agent, or Firm* — Baker Hughes Company

(57) ABSTRACT

A cutting element includes a substrate and a volume of polycrystalline diamond (PDC) on the substrate. The PDC volume has a front cutting face, a lateral side surface, and a cutting edge between the front cutting face and the lateral side surface. The cutting edge has a cutting apex and extends between a first side flat surface and a second side flat surface. The side flat surfaces are disposed on opposing sides of the cutting apex. The cutting edge further includes a first chamfer surface and a second chamfer surface, which are located adjacent to one another and oriented at a first angle relative to one another at the cutting apex. The cutting edge includes one of: an arcuate edge having a radius of curvature; and a linear edge having discrete linear edges adjacent one another and separated by a second angle.

19 Claims, 9 Drawing Sheets

(56) References Cited

U.S. PATENT DOCUMENTS

| | | | | |
|---|---|---|---|---|
| 6,935,444 | B2 * | 8/2005 | Lund | E21B 10/567 175/426 |
| 8,783,387 | B2 | 7/2014 | Durairajan et al. | |
| 9,598,909 | B2 | 3/2017 | Patel | |
| 9,650,837 | B2 | 5/2017 | Patel et al. | |
| 10,378,289 | B2 | 8/2019 | Stockey | |
| 10,570,668 | B2 | 2/2020 | Izbinski et al. | |
| 10,724,304 | B2 | 7/2020 | Bomidi et al. | |
| 11,828,109 | B2 * | 11/2023 | Bomidi | E21B 10/567 |
| 2007/0131458 | A1 * | 6/2007 | Shen | E21B 10/5673 175/426 |
| 2013/0306377 | A1 | 11/2013 | Digiovanni et al. | |
| 2017/0234078 | A1 | 8/2017 | Patel et al. | |
| 2018/0148978 | A1 | 5/2018 | Chen | |
| 2018/0320450 | A1 | 11/2018 | Borge | |
| 2019/0330928 | A1 * | 10/2019 | Graham | E21B 10/5673 |
| 2021/0180410 | A1 * | 6/2021 | Yu | E21B 10/43 |
| 2021/0245244 | A1 | 8/2021 | Robertson et al. | |

FOREIGN PATENT DOCUMENTS

| | | | |
|---|---|---|---|
| EP | 1052367 | B1 | 4/2005 |
| WO | 2018/231343 | A1 | 12/2018 |
| WO | 2021/158218 | A1 | 8/2021 |

OTHER PUBLICATIONS

International Written Opinion for Application No. PCT/US2022/080536 dated Mar. 13, 2023, 5 pages.

Lyons et al., U.S. Appl. No. 17/510,193 titled Selectively Leached Thermally Stable Cutting Element in Earth-Boring Tools, Earth-Boring Tools Having Selectively Leached Cutting Elements, and Related Methods, filed Oct. 25, 2021.

* cited by examiner

CUTTING ELEMENTS AND GEOMETRIES, EARTH-BORING TOOLS, AND RELATED METHODS

TECHNICAL FIELD

This disclosure relates generally to cutting elements for use on earth-boring tools during earth-boring operations. In particular, embodiments of the present disclosure relate to cutting elements having geometries for improved mechanical efficiency.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using earth-boring tools, such as an earth-boring rotary drill bit. The earth-boring rotary drill bit is rotated and advanced into the subterranean formation. As the earth-boring rotary drill bit rotates, the cutters or abrasive structures thereof cut, crush, shear, and/or abrade away the formation material to form the wellbore.

The earth-boring rotary drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom-hole assembly" (BHA).

The earth-boring rotary drill bit may be rotated within the wellbore by rotating the drill string from the surface of the formation, or the drill bit may be rotated by coupling the drill bit to a downhole motor, which is coupled to the drill string and disposed proximate the bottom of the wellbore. The downhole motor may include, for example, a hydraulic Moineau-type motor having a shaft, to which the earth-boring rotary drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

Different types of earth-boring rotary drill bits are known in the art, including fixed-cutter bits, rolling-cutter bits, and hybrid bits (which may include, for example, both fixed cutters and rolling cutters). Fixed-cutter bits, as opposed to roller cone bits, have no moving parts and are designed to be rotated about the longitudinal axis of the drill string. Most fixed-cutter bits employ Polycrystalline Diamond Compact (PDC) cutting elements. The cutting edge of a PDC cutting element drills rock formations by shearing, like the cutting action of a lathe, as opposed to roller cone bits that drill by indenting and crushing the rock. The cutting action of the cutting edge plays a major role in the amount of energy needed to drill a rock formation.

A PDC cutting element is usually composed of a thin layer, (e.g., about 0.3 mm to about 5 mm), of polycrystalline diamond bonded to a cutting element substrate at an interface. The polycrystalline diamond material is often referred to as the "diamond table." A PDC cutting element is generally cylindrical with a diameter from about 8 mm up to about 24 mm. However, PDC cutting elements may be available in other forms such as oval or triangle-shapes and may be larger or smaller than the sizes stated above.

A PDC cutting element may be fabricated separately from the bit body and secured within cutting element pockets formed in the outer surface of a blade of the bit body. A bonding material such as an adhesive or, more typically, a braze alloy may be used to secure the PDC cutting element by its supporting substrate within the pocket. The diamond table of a PDC cutting element is formed by sintering and bonding together relatively small diamond grains under conditions of high temperature and high pressure (HTHP) in the presence of a catalyst (such as, for example, cobalt, iron, nickel, or alloys and mixtures thereof) to form a layer or "table" of polycrystalline diamond material on the cutting element substrate.

FIGS. 1A, 1B, and 1C illustrate perspective, face, and side views, respectively, of a prior art conventional Polycrystalline Diamond Compact (PDC) cutting element 100. The polycrystalline diamond table (diamond table) 104 is bonded to the substrate 106 at an interface 110. Before being used, a PDC cutting element typically has a round, planar front cutting face 108 and a circular peripheral cutting edge 102. The planar front cutting face 108 is perpendicular to a longitudinal axis 112 of the cutting element 100 and generally parallel to the interface 110 between the diamond table 104 and the substrate 106. The cutting edge 102 of the PDC cutting element 100 is where the planar front cutting face 108 meets the longitudinal cylindrical side surface of the diamond table 104. The cutting edge 102 of a PDC cutting element 100 drills rock formations by shearing the formation material. The cutting action of the cutting edge 102 plays a major role in the amount of energy needed to drill a rock formation. During use, as the cutting edge 102 of the PDC cutting element 100 wears, a generally planar wear scar, also termed a wear flat, develops at the cutting edge 102. Eventually, the cutting edge 102 in contact with the formation becomes linear as the wear scar forms and develops.

The substrate 106 may comprise a cermet material (i.e., a ceramic metal composite material) such as, for example, cobalt cemented tungsten carbide. In such instances, the cobalt (or other catalyst material) in the substrate 106 may be swept into the diamond grains during sintering and serves as the catalyst material for forming the inter-granular diamond-to-diamond bonds between the diamond grains in the diamond table 104.

Upon formation of a diamond table using the HTHP process, catalyst material may remain in interstitial spaces between the grains of the diamond table. The presence of the catalyst material in the diamond table may contribute to degradation in the diamond-to-diamond bonds between the diamond grains in the diamond table when the cutting element 100 gets hot during use. Degradation of the diamond-to-diamond bonds due to heat is referred to as "thermal damage" to the diamond table 104. Therefore, it is advantageous to minimize the amount of heat to which a cutting element 100 is exposed. This may be accomplished by reducing the rate of penetration of the earth-boring rotary drill bit. However, reduced rate of penetration, means longer drilling time and higher costs associated with drilling, while cutting element failure means stopping the drilling process to remove the drill string in order to replace the drill bit. Thus there is a need for cutting elements with improved rates of penetration and durability.

One method to enhance the durability of a PDC cutting element is modify the cutting edge of the PDC cutting element to reduce stress points. For example, tapered surfaces may be formed in the cylindrical side surface of the cutting element as illustrated in FIGS. 2A, 2B, and 2C. FIGS. 2A, 2B, and 2C illustrate perspective, face and side views, respectively, of a prior art PDC cutting element 200. The planar front cutting face 208 is perpendicular to a longitudinal axis of the cutting element 200 and generally parallel to the interface 210 between the diamond table 204 and the substrate 206. The PDC cutting element 200 comprises a polycrystalline diamond table 204 and a substrate 206 bonded together at an interface 210. It is known in the industry to form planar tapered surfaces 216 into the side surface of the PDC cutting element 200 adjacent to the cutting face 208 and cutting edge 202 of the cutting element 200.

Another method to improve the efficiency and durability of cutting element 200 is to form chamfered edges 214 on the cutting edge 202 of the diamond table 204. It is known in the industry to chamfer edges of a PDC cutting element 200 to enhance the durability of the PDC cutting element 200. Diamond tables 204 with chamfered edges 214 on the cutting edge 202 have been found to have a reduced tendency to spall and fracture.

Multi-chamfered Polycrystalline Diamond Compact (PDC) cutting elements are also known in the art. For example, a multi-chamfered cutting element is taught by Cooley et al., U.S. Pat. No. 5,437,343, assigned to the assignee of the present invention. In particular, the Cooley et al. patent discloses a PDC cutting element having a polycrystalline diamond material having two concentric chamfers.

It is also known in the industry to modify the shape of the diamond table to improve cutting element efficiency and durability. U.S. Pat. No. 5,333,699 to Thigpin et al. is directed to a cutting element having a spherical first end opposite the cutting end. Cutting element variations, illustrated in FIGS. 22-29 of Thigpin et al., comprise channels or holes formed in the cutting face. U.S. Pat. No. 9,598,909 to Patel is directed to cutting elements with grooves on the cutting face as illustrated in FIGS. 9-13 of Patel.

U.S. Pat. No. 4,109,737 to Bovenkerk is directed toward cutting elements having a thin layer of polycrystalline diamond bonded to a free end of an elongated pin. One particular cutting element variation illustrated in FIG. 4G of Bovenkerk, comprises a generally hemispherical diamond layer having a plurality of flats formed on the outer surface thereof.

U.S. Pat. No. 10,378,289 to Stockey and U.S. Patent Publication U.S. 2017/0234078 A1 to Patel et al. are directed towards a cutting face of a cutting element having multiple chamfers forming concentric rings on the cutting face. One particular cutting element variation, illustrated in FIG. 1 of Stockey, comprises a ring surface with a chamfer at the cutting edge surrounding an annular recess which in turn surrounds a planar circle at the center of the cutting face. Another cutting element variation illustrated in FIG. 2 of Patel et al., comprises multiple raised ring surfaces and multiple annular recesses surrounding a planar circle at the center of the cutting face.

U.S. Pat. No. 6,196,340 to Jensen is directed to raised surface geometries on non-planar cutting elements. One variation, illustrated in FIG. 4A of Jensen, comprises a four-sided pyramidal shape with a planar square surface at the top.

U.S. Patent Publication 2018/0148978 A1 to Chen is directed toward a cutting element with a raised hexagonal shape. Another cutting element variation, illustrated in FIG. 5A of Chen, comprises a raised hexagonal shape having chamfered edges. Another cutting element variation, illustrated in FIG. 5C of Chen, comprises a raised cutting surface having six round "teeth."

U.S. Pat. No. 8,783,387 to Durairajan et al. is directed to cutting elements having geometries for high Rate of Penetration (ROP). One cutting element variation, illustrated in FIGS. 4 and 5 of Durairajan et al., comprises a cutting element having a shaped cutting surface comprising a raised triangular shape. Another cutting element variation, illustrated in FIGS. 5 and 6, of Durairajan et al., comprises a cutting element with a raised triangle having a beveled or chamfered edge.

PCT Publication WO 2018/231343 to Cuillier De Maindreville et al. is directed to superabrasive bits with multiple raised cutting surfaces. One cutting element variation, illustrated in FIG. 1, of Cuillier De Maindreville et al., comprises raised triangular shapes similar to Durairajan et al.

U.S. Pat. No. 5,499,688 to Dennis is directed to PDC cutting elements. Cutting element variations, illustrated in FIGS. 7-11 of Dennis, comprise cutting elements with various raised shapes including triangular and hexagonal shapes.

BRIEF SUMMARY

In some embodiments, the present disclosure includes a cutting element for forming a borehole through a subterranean formation. The cutting element includes a substrate having a substrate and a volume of polycrystalline diamond on the substrate. The volume of polycrystalline diamond includes a front cutting face, a lateral side surface, and a cutting edge between the front cutting face and the lateral side surface. The cutting edge has a cutting apex and extends between a first side flat surface and a second side flat surface. The first side flat surface and the second side flat surface are disposed on opposing sides of the cutting apex of the cutting edge. The cutting edge also includes a first chamfer surface and a second chamfer surface. The first and second chamfer surfaces are located adjacent to one another and oriented at a first angle relative to one another at the cutting apex. The cutting edge includes one of: an arcuate edge having a radius of curvature; and a linear edge having at least two discrete linear edges adjacent one another and separated by a second angle.

In some embodiments, the present disclosure includes an earth-boring tool for forming a borehole through a subterranean formation. The earth-boring tool includes a boring body and a cutting element secured to the boring body. The cutting element includes a substrate having a base and a substrate volume. The cutting element further includes a volume of polycrystalline diamond on the substrate. The volume of polycrystalline diamond includes a front cutting face, a lateral side surface, and a cutting edge between the front cutting face and the lateral side surface. The cutting edge includes a cutting apex and extends between a first side flat surface and a second side flat surface. The first side flat surface and the second side flat surface are disposed on opposing sides of the cutting apex of the cutting edge. The cutting edge is oriented at a first angle relative to the lateral side surface. The cutting edge includes one of: an arcuate edge having a radius of curvature; and a linear edge having at least two discrete linear edges adjacent one another and separated by a second angle. The cutting element further includes an interface between the substrate and the volume of polycrystalline diamond. The interface is separated from the base of the substrate by a majority of the substrate volume.

In some embodiments, the present disclosure includes a method of manufacturing an earth-boring tool for forming a borehole through a subterranean formation. The method includes forming a boring body and forming at least one socket in a leading edge section of the boring body. The method further includes forming a cutting element for the at least one socket of the boring body. Wherein, forming the cutting element comprises: forming a substrate; forming a volume of polycrystalline diamond on the substrate; shaping the volume of polycrystalline diamond and the substrate to have two or more side flat surfaces, a front cutting face, and a cutting apex. Wherein shaping the volume of polycrystalline diamond and the substrate further comprises: disposing a first side flat surface and a second side flat surface of the two or more side flat surfaces on opposing sides of the cutting apex; and forming a cutting edge to extend between the first side flat surface and the second side flat surface and to have a first chamfer surface and a second chamfer surface. The first and second chamfer surfaces are located adjacent to one another and oriented at an angle relative to one another at the cutting apex. The cutting edge is further formed to include one of: an arcuate edge; and a linear edge. Wherein an amount of chamfering relative to the first chamfer surface and the second chamfer surface is selectively chosen to distribute a cutting load or to reduce stress placed on the cutting apex. The method further includes placing the cutting element in the at least one socket of the boring body.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein:

FIGS. 6A, 6B, and 6C illustrate perspective, face, and side views of an embodiment of a PDC cutting element in accordance with the present disclosure;

DETAILED DESCRIPTION

Figure 1A:
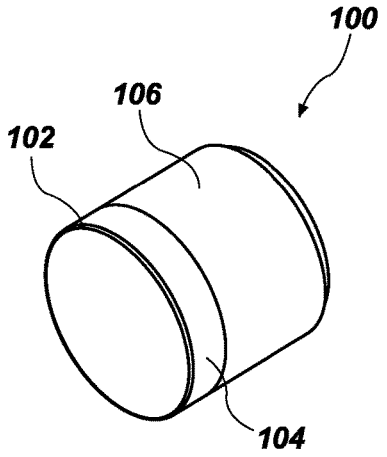
FIG. 1A (Prior Art)
FIGS. 1A, 1B, and 1C illustrate perspective, face, and side views of an embodiment of a PDC cutting element in accordance with the prior art.
Figure 1B:
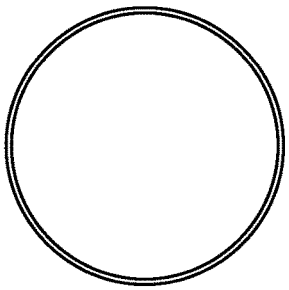
FIG. 1B (Prior Art)
Figure 1C:
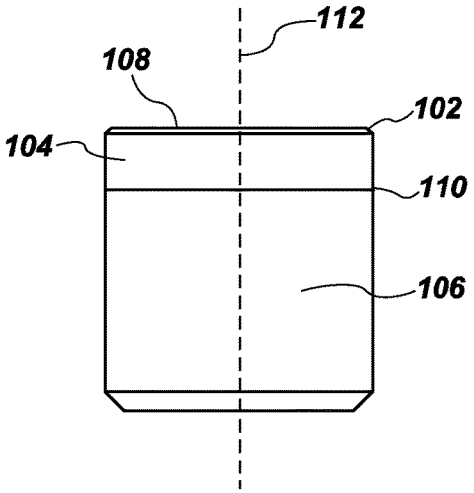
FIG. 1C (Prior Art)
Figure 2A:
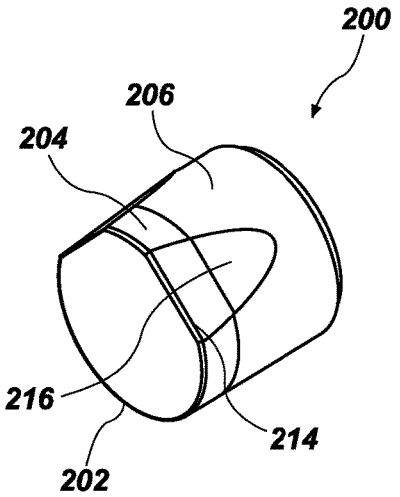
FIG. 2A (Prior Art)
FIGS. 2A, 2B, and 2C illustrate perspective, face, and side views of an embodiment of a PDC cutting element in accordance with the prior art.
Figure 2B:
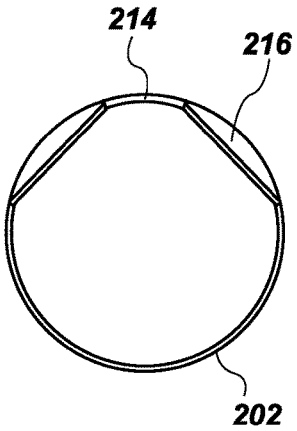
FIG. 2B (Prior Art)
Figure 2C:
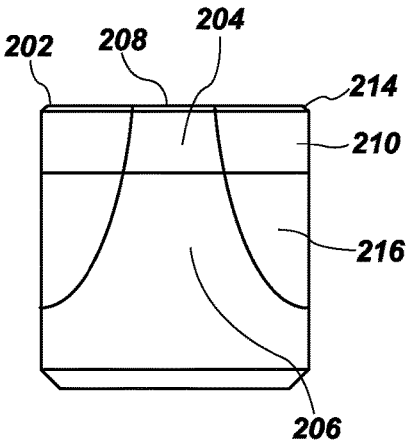
FIG. 2C (Prior Art)

The illustrations presented herein are not actual views of any particular cutting assembly, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. The drawings accompanying the application are for illustrative purposes only, and are not drawn to scale. Additionally, elements common between figures may have corresponding numerical designations.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any cutting element when utilized in a conventional manner. Furthermore, these terms may refer to an orientation of elements of any cutting element as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

As used herein, the term polycrystalline diamond compact or "PDC" used in reference to cutters for drill bits means a cutting element attached, or to be attached, to a drill bit or another earth-boring tool. The cutting element includes a thin volume of polycrystalline diamond formed on a surface of a substrate. This thin volume may also be referred to as a "diamond table," which is a superabrasive or superhard material and is generally thinner than a substrate volume on which it is formed or to which it is attached after formation. The diamond table may include synthetic, natural, or combinations of synthetic and natural diamond grains, crystals, or "grit" sintered together within the substrate. The substrate is formed of a hard, binding metal material or matrix, which often is tungsten carbide. The tungsten carbide cements the natural or synthetic diamonds together. The sintering occurs under high temperature and high pressure (HTHP) conditions in which interstitial elements of the substrate act similar to solvents for the carbon elements within the substrate. The interstitial elements include Group 9 transition metals. In embodiments, the interstitial elements include cobalt. In some instances, the diamond table is finished by an acid leaching process (e.g., using aqua regia) applied to a cutting face of the diamond table, substantially removing catalyst (i.e., solvent) interstitial elements from about 10 to 100 microns of polycrystalline diamond depth from the cutting face. Leaching may also be conducted along the side of the diamond table, below the leach depth on the cutting face. The remaining interstitial elements are not leached to provide stability and durability to remaining portions of the cutting element. It is important to note that leaching and non-leaching may affect the brittleness of the diamond table and an ability to adhere the diamond table to the substrate of the cutter, which is why the amount or depth of leaching is optimized herein.

As used herein, the term "cutter" or "cutting element" means a PDC volume and substrate volume formed as a three-dimensional (3D) shape, which is often cylindrical or semi-cylindrical, but can include other shapes such as pyramids, cones, cubes, triangular prisms, tetrahedrons, and combinations thereof. The PDC and substrate volumes are generally a unitary element, distinguished from each other during the formation of the respective volumes; however, these volumes can also be two separate, distinct volumes that are subsequently otherwise secured together after formation of each respective volume. The cutter or cutting element is often brazed or otherwise joined to a body for removing subterranean material from the borehole using the outer perimeter of the cutter. For example, the cutting element may be mounted to the body of a drill bit by press-fitting, locking, brazing, or otherwise fixing the cutter into a preformed pocket, socket, or receptacle and a semi-circular periphery edge of the cutter is used to bore into the earth.

As used herein, the term "stressful conditions" means problems or conditions encountered during drilling and well-boring that hinder a desired resultant parameter, such as DOC or ROP. For example, stressful conditions include unwanted drill bit vibration. This type of vibration can place imbalanced forces on the drill bit. Whirling, drilling bind, formation balling, and drill bit tilt may also be stressful conditions. Stressful conditions can also include increased tangential, shear, and/or axial forces exerted at points of a cutting edge, resulting in cracking or increased heat stress at the cutting edge.

As used herein, the term "dual chamfer" means two cutting separate and distinct surfaces adjacent each other and formed on a portion of a cutter or cutter element. In embodiments, the portion at which the dual chamfering is located is a facial surface of the diamond table of a cutter; however, other locations for the dual chamfering are contemplated herein, such as along the base of the cutter or along an edge of the substrate that is positioned axially opposite the cutting edge. The facial surface of the diamond table is perpendicular to a central axis of the cutter. In some embodiments, the chamfering may be performed during a machining process after the substrate and polycrystalline diamond volumes are formed. In other embodiments, the chamfering may occur as a result of a mold, a cast, or a laser process.

There are multiple types of drilling applications, including but not limited to, straight-hole, straight-hole rotary, motor- and rotary-steerable, and slimhole applications. Earth-boring tools are often tailored to the specific application. For example, the shape and dimension of a drill bit used may vary for straight-hole applications as compared to drill bits used for steerable applications.

Similarly, the specific earth-boring tool type is tailored to specific drilling circumstances. A drill bit may be chosen based on the drilling application, the formation and its characteristics, or combinations thereof. For example, drill bits may encounter formations including medium-to-hard, abrasive, rocky, fragmented, interbedded, and pressurized formations. Drill bits used for each of these different formations may vary depending on the formation and its characteristics, such as those encountering formation stratification, or the uneven variation between comparatively soft and hard formations.

In well-boring, the operator has multiple, real-time parameters that are adjusted under specific circumstances to achieve desired resultant parameters. For example, an operator may adjust weight-on-bit (WOB), torque, or RPMs to achieve a desired rate-of-penetration (ROP) or depth-of-cut (DOC). Some of the adjustable parameters are intentionally limited. For example, structures may be placed on drill bits to limit the DOC, and are sometimes referred to as depth-of-cut controls (DOCC). In some instances, the intentional limits prevent operators from unintentionally damaging drill bits by making adjustments that may or may not be appropriate according to the specific circumstances.

Additional real-time parameters include backrake and siderake angle adjustments to reduce the WOB sensitivity. Proper adjustments may reduce the stressful conditions placed on cutting elements during drilling, including torsional variance.

Improvements in the characteristics of cutting elements along with further improvements in cutting element efficiency and durability may be achieved in accordance with embodiments of the present disclosure. Improvements in cutting edge geometry affects bit stability, durability and efficiency. Improvements include, but are not limited to, the use of dual chamfers to reduce loads seen on a cutting apex as compared to loads seen on cutting apexes with a single chamfer. Dual chamfers also distribute the loads more equally across the cutting face (e.g., putting the load on two planes instead of one). Dual chamfers also reduce temperatures (e.g., reducing thermal stress) seen at the cutting apex by improving cutting and debris evacuation from the cutting face. Without being bound by theory, these angle adjustments provided by the dual chamfers and the geometries discussed below help reduce axial and shear stress on an edge of a cutting element, thereby enabling increased torque, bit aggressiveness, and cutting element durability and lifespan.

Downhole earth-boring tools, having cutting elements that have novel geometries are described in further detail below. Additional improvements include an ability to tailor cutter elements for specific drilling applications, circumstances, tool types, drilling parameters, and combinations thereof. The tailoring of the cutter element can occur prior to drilling or after the drilling has commenced.

Figure 3A:
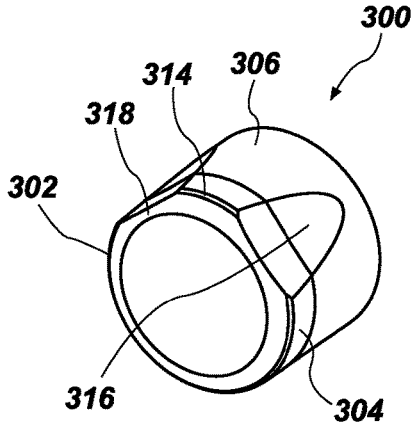
FIGS. 3A, 3B, and 3C illustrate perspective, face, and side views of an embodiment of a PDC cutting element in accordance with the present disclosure.
Figure 3B:
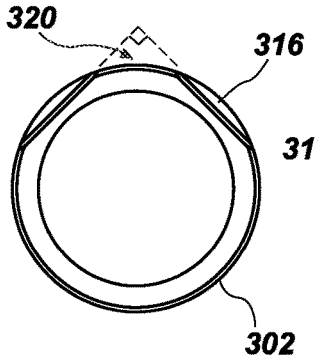
Figure 3C:
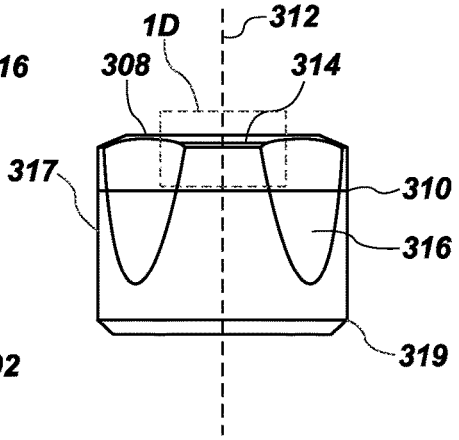

FIGS. 3A, 3B, and 3C illustrate perspective, face, and side views, respectively, of an embodiment of a PDC cutting element 300 in accordance with the present disclosure. The PDC cutting element 300 comprises a continuous, or semi-continuous, cutting edge 302 formed in a three-dimensional (3D) PDC volume 304. In some embodiments, the PDC volume is integrally connected with substrate volume 306 during formation of the diamond table. In other embodiments, the PDC volume is brazed or otherwise secured to substrate volume 306. The PDC volume 304 includes a cutting face 308 that is parallel to the interface 310 between PDC volume 304 and substrate volume 306, and is also perpendicular to the longitudinal axis 312. PDC volume 304 and substrate volume 306 share longitudinal axis 312. As illustrated in FIGS. 3A, 3B, and 3C, the cutting edge 302 is around the perimeter of cutting element 300 and is a dual chamfered edge. The dual-chamfering includes a primary chamfer surface 314, which is interrupted by side flats 316, and a secondary chamfer surface 318. The two side flats 316 are disposed on opposing sides of the cutting apex 320 of the cutting edge 302. The cutting edge 302 of the cutting apex 320 at the end of the semi-cylindrical PDC volume 304 is oriented towards the formation material. In embodiments, side flats 316 are formed at an angle ranging from about 1° to 15° relative to a side surface of the cutting element 300. In other words, at least one surface of the side flats 316 tapers away from the lateral side surface 317 at an angle ranging from about 1° to 15° relative to the lateral side surface 317 with a 2° to 10° variance. In some embodiments, the angle of the tapering side flats 316 ranges from about 3° to 10° relative to the lateral side surface 317. In other embodiments, the angle of the tapering side flats 316 ranges from about 4° to 6° relative to the lateral side surface 317.

The barrel thickness of the primary chamfer surface 314 may range from 0.005 to 0.025 inches relative to (i.e., parallel to) a lateral side surface of the cutting element. In some embodiments, the barrel thickness of the primary chamfer surface 314 ranges from 0.007 to 0.02 inches relative to a lateral side surface of the cutting element. In other embodiments, the barrel thickness of the primary chamfer surface 314 ranges from 0.008 to 0.012 inches relative to a lateral side surface of the cutting element.

The barrel thickness of the secondary chamfer surface 318 may range from 0.010 to 0.040 inches relative to a lateral side surface of the cutting element. In some embodiments, the barrel thickness of the secondary chamfer surface 318 ranges from 0.015 to 0.03 inches relative to a lateral side surface of the cutting element. In other embodiments, the barrel thickness of the primary chamfer surface 314 ranges from 0.018 to 0.022 inches relative to a lateral side surface of the cutting element.

A ratio of the PDC volume 304 to the substrate volume may be from about 1:2 to about 1:25. In some embodiments, the ratio may be from about 1:2 to about 1:10. In other embodiments, the ratio may be from about 1:3 to about 1:6. A volume removed from the cutting element 300 to form a side flat 316 may be from about 2% to 20% of the total cutting element volume.

The substrate volume 306 includes a base 319 that is separated from the interface 310 by a majority (e.g., greater than 50%) of the substrate volume 306. In some embodiments, the base 319 has a circular circumference. In these embodiments, the circular circumference of the base 319 circumscribes each of the linear surfaces of the cutting edge 302 (i.e., if the circumference were vertically projected up onto the cutting face), including the edges of side flats 316. The base 319 may also include a single chamfer or a dual chamfer. It is important to note that the substrate volume 306 may take on various other shapes other than circular and cylindrical, such that the base would have forms with dimensions corresponding to the various shapes of the substrate volume.

The cutting face 308 may include different regions associated with a leach depth, resulting from one or more leaching processes. These leaching processes are discussed in greater detail in patent application Ser. No. 17/510,193, titled SELECTIVELY LEACHED THERMALLY STABLE CUTTING ELEMENT IN EARTH-BORING TOOLS, EARTH-BORING TOOLS HAVING SELECTIVELY LEACHED CUTTING ELEMENTS, AND RELATED METHODS, by Nicholas J. Lyons et al., which is incorporated herein by this reference in its entirety.

Figures 8A, 8B, 8C:
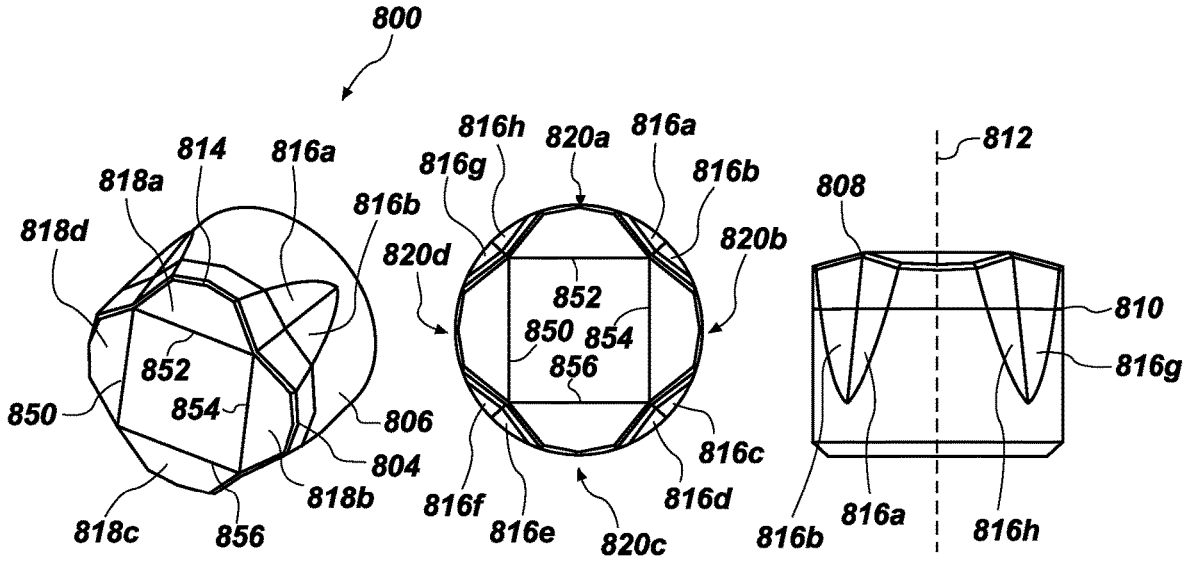
FIGS. 8A, 8B, and 8C illustrate perspective, face, and side views of an embodiment of a PDC cutting element in accordance with the present disclosure.

Each of the surfaces of the cutting face 308 may be polished, or one or more of the surfaces of the cutting face 308 may be at least partially non-polished (e.g., lapped, but not polished). In addition, the cutting edge 302 may be at least partially (e.g., substantially) chamfered (e.g., beveled), may be at least partially (e.g., substantially) radiused (e.g., arcuate), may be partially chamfered and partially radiused, or may be non-chamfered and non-radiused. As shown in FIG. 3A, a perimeter of the cutting edge 302 may be chamfered. In some embodiments, the cutting apex 320 in FIG. 3A may be chamfered and the cutting element includes a recessed surface, having one or more chamfered or non-chamfered surfaces (FIG. 8A below). In other embodiments, only the cutting apex of a cutting element may be chamfered. In other words, an amount or an extent of chamfering is varied to accomplish at least one of: reduce loads exerted on a cutting tip (e.g., placing the load at the apex of two planes instead of a single plane); reduce thermal stress occurring at the cutting tip by improving an evacuation of cuttings and debris away from the cutting face; and enable the cutting element to stay sharper longer. For example, in some embodiments, the dual chamfering may be placed around an entire perimeter of a cutting element, and even in portions of a recessed surface formed in the cutting face of the cutting element, to allow an improved flow of debris and reduced thermal stress during drilling. In other embodiments, the dual chamfering may be restricted to the apex portion of the cutting element, thereby distributing loads across two planes on either side of the apex. Without being bound by theory, the loads may be redistributed axially (i.e., as compared to a cutting element with a single chamfer), from the cutting face towards the base of the substrate.

A height (e.g., thickness) of the PDC volume 304 may be within a range of from about 0.3 millimeters (mm) to about 5 mm. In some embodiments, the height of the PDC volume ranges of from about 1.0 millimeters (mm), to about 4.5 mm. In other embodiments, the height of the PDC volume ranges from 2.0 mm to 4.0 mm.

Figure 3D:
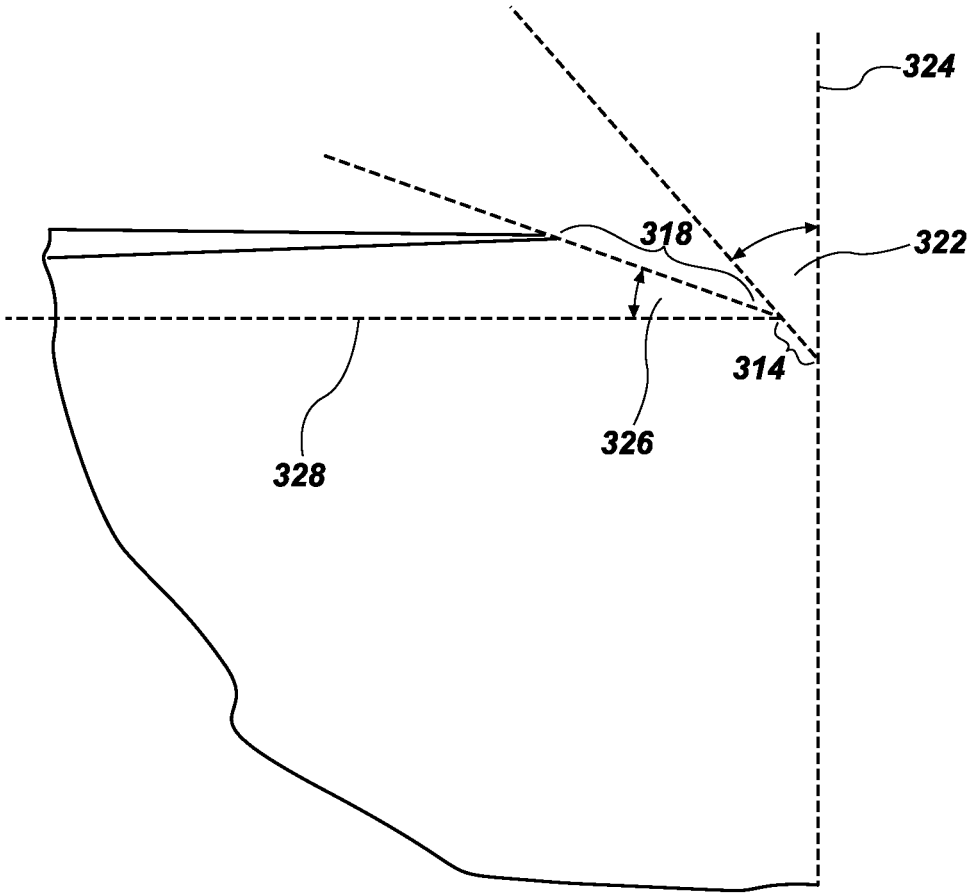
FIG. 3D illustrates an enlarged view of a portion of the PDC cutting element of FIG. 3C.

FIG. 3D is an enlarged view of a portion of the cutting element depicted in FIG. 3C. The primary chamfer surface 314 is formed having angle 322, and the secondary chamfer surface 318 is formed having angle 326 relative to either a horizontal plane, a side surface, or an axis that is parallel to the horizontal or side surface, respectively. For example, the angle 322 is formed relative to longitudinal axis 324, which is parallel to the lateral side surface 317 of the cutting element, while the angle 326 is formed relative to a horizontal plane 328 that is parallel to the cutting face 308 of the cutting element. In embodiments, the angle 322 or the angle 326 is optimized to reduce stressful conditions on the cutting element. For example, the angle 326 may be one-third as sharp as the angle 322. Accordingly, the angle 326 may range from 5° to 25°, with a 2° to 10° variance; while the angle 322 may range from 35° to 55°, with a 2° to 10° variance. In some embodiments, the angle 326 ranges from 10° to 20°; while the angle 322 ranges from 40° to 50°. In other embodiments, the angle 326 ranges from 13° to 17°; while the angle 322 ranges from 43° to 47°. In some embodiments, the angles 322 and 326 are tailored, chosen, varied, or further optimized to reduce loads exerted on the cutting apex by angling the planes existing at the cutting apex relative to subterranean formations or to account for stressful conditions. In other embodiments, the surface area of the planes at the cutting apex is optimized according to respective stressful conditions, drilling applications, drill-bit or drilling body type, real-time parameters, resultant parameters, and combinations thereof.

Figure 4A:
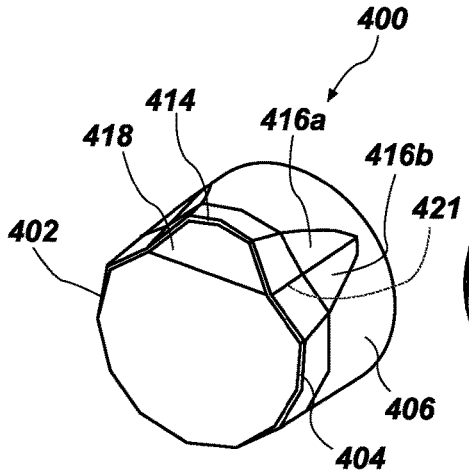
FIGS. 4A, 4B, and 4C illustrate perspective, face, and side views of an embodiment of a PDC cutting element in accordance with the present disclosure.
Figure 4B:
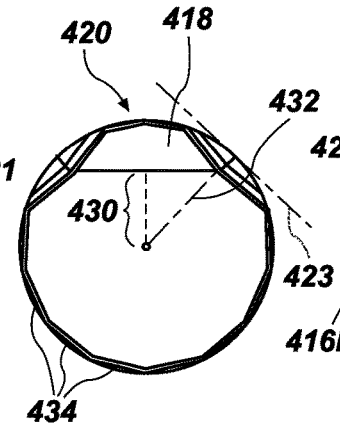
Figure 4C:
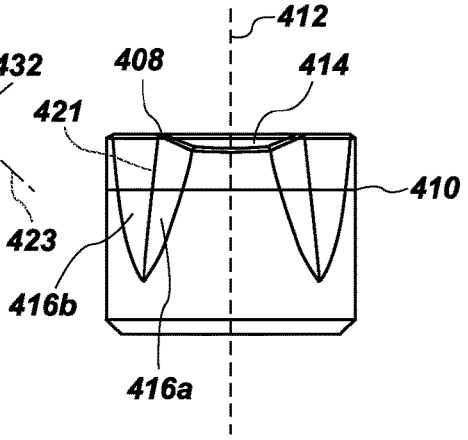

FIGS. 4A, 4B, and 4C illustrate perspective, face, and side views, respectively, of an embodiment of a PDC cutting element 400 in accordance with the present disclosure. The PDC cutting element 400 includes a cutting edge 402 formed in the PDC volume 404 having multiple, discrete, chamfered cutting surfaces 434. The PDC cutting element further includes dual side flats 416. The angle of each plane of formation of each side flat surface of a dual side flat 416*a* and 416*b*, respectively may range from 1° to 15°, with a 2° to 10° variance, relative to the midpoint formation line 421 and a tangent line 423 of the side flat. In some embodiments, the angle of each plane may range from 2° to 10° relative to the midpoint formation line 421 and the tangent line 423 of the side flat. In other embodiments, the angle of each plane of formation of a surface of a dual side flat 416*a* and 416*b* ranges from 3° to 7° relative to the midpoint formation line 421 and the tangent line 423.

The PDC volume 404 includes a cutting face 408 that is circumscribed by a circle (see FIG. 5B) having a radial dimension 432. The circumscribing circle has the same circumference as a portion of the substrate volume 406 (e.g., a portion without a side flat, which may coincide with the base of the substrate). An edge of the secondary chamfer 418 has a radial dimension 430 that is less than the radial dimension 432. It is important to note that although the edge of secondary chamfer 418 is depicted as linear, other non-linear formation lines, such as edges of chamfered surfaces, are contemplated and included herein.

PDC volume 404 and substrate volume 406 share longitudinal axis 412. As illustrated in FIGS. 4A, 4B, and 4C, the cutting edge 402 is around the perimeter of cutting element 400, is substantially axially aligned with the longitudinal axis 412, and includes a dual chamfered edge. The dual-chamfering includes a primary chamfer 414, which is connected by the chamfering of first dual side flats 416*a* and 416*b* and corresponding second dual side flats opposite the first (shown, but not labeled), and a secondary chamfer 418. Each of the dual side flats 416 includes two tapered planar surfaces.

The optimal orientation for PDC cutting element 400 is to have the cutting edge 402 of the apex 420 at the end of the semi-cylindrical PDC volume 404 oriented towards the formation material. In other embodiments, as will be discussed in greater detail below, the cutting element 400 may be rotationally removed and rotated, such that the multiple, discrete, chamfered cutting surfaces 434 are oriented towards the formation material. After rotation, the cutting element is rotationally re-attached to resume drilling.

Figure 5A:
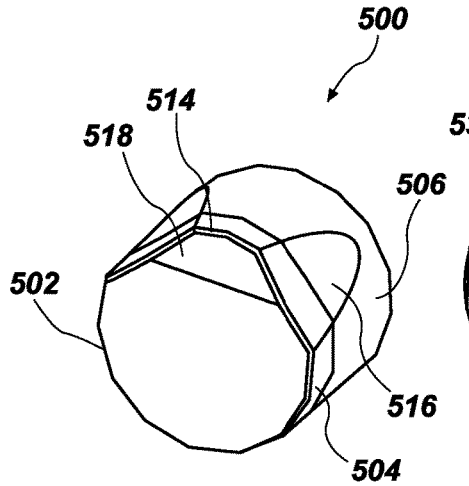
FIGS. 5A, 5B, and 6C illustrate perspective, face, and side views of an embodiment of a PDC cutting element in accordance with the present disclosure.
Figure 5B:
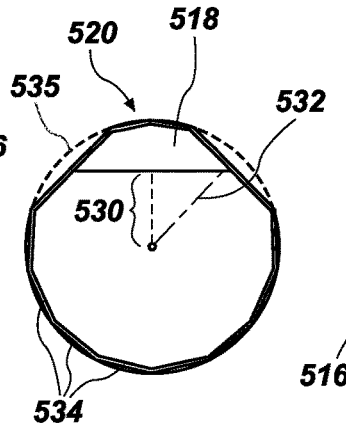
Figure 5C:
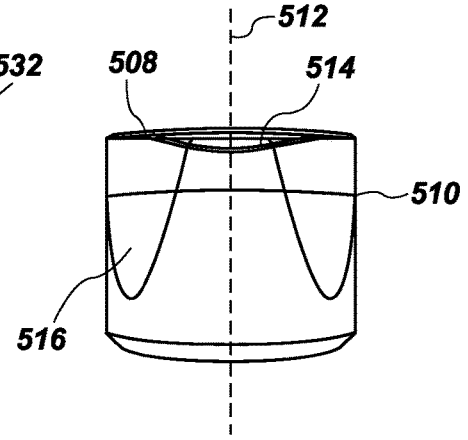

FIGS. 5A, 5B, and 5C illustrate perspective, face, and side views, respectively, of an embodiment of a PDC cutting element 500 in accordance with the present disclosure. The PDC cutting element 500 includes a cutting edge 502 formed in the PDC volume 504 having multiple, discrete, chamfered cutting surfaces 534. The cutting apex 520 is circumscribed by circle 535. The cutting element 500 is similar to cutting element 400 except that side flats 516 formed in the PDC volume 504 and substrate 506 have single tapered surfaces. Although the two side flats 516 are depicted as being separated by a 90-degree angle to form the cutting apex 520 between the side flats, other separation angles as discussed below are contemplated herein.

Figure 6A:
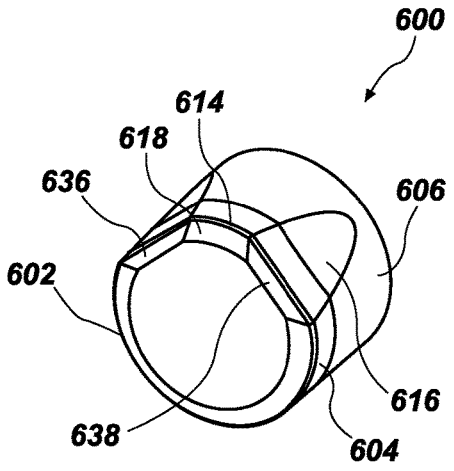
Figure 6B:
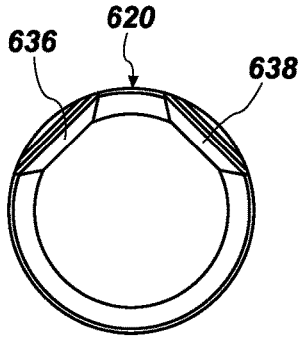
Figure 6C:
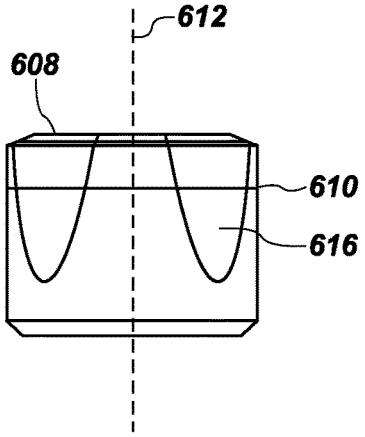

FIGS. 6A, 6B, and 6C illustrate perspective, face, and side views, respectively, of an embodiment of a PDC cutting element 600 in accordance with the present disclosure. The PDC cutting element 600 includes a semi-continuous cutting edge 602 formed in the PDC volume 604. The cutting edge 602 is semi-continuous because side flats 616 include dual chamfered surfaces, such that secondary chamfered surface 636 and secondary chamfered surface 638 disrupt the continuity of the cutting edge 602. The optimal orientation for PDC cutting element 600 is to have the discontinuous portion of cutting edge 602, or the portion including cutting apex 620 and chamfered surfaces 636 and 638, oriented towards the formation material.

Figure 7A:
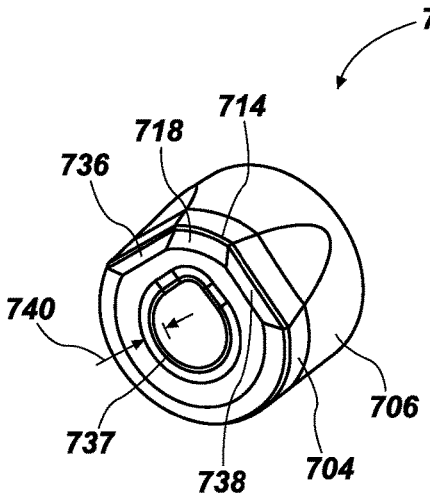
FIGS. 7A, 7B, and 7C illustrate perspective, face, and side views of an embodiment of a PDC cutting element in accordance with the present disclosure.
Figure 7B:
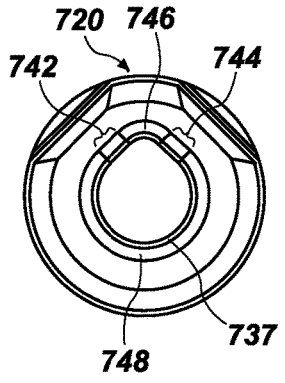
Figure 7C:
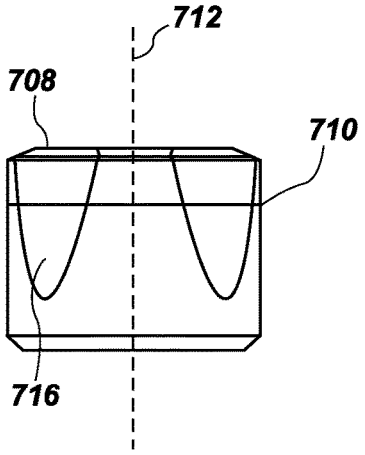

FIGS. 7A, 7B, and 7C illustrate perspective, face, and side views, respectively, of an embodiment of a PDC cutting element 700 in accordance with the present disclosure. The PDC cutting element 700 includes a semi-continuous cutting edge formed in the PDC cutting volume 704. The cutting edge is semi-continuous because side flats 716 include, or are connected to, additional chamfered surfaces 736 and 738. The additional chamfered surfaces 736 and 738 are made up of dual chamfered surfaces, including a first primary chamfered surface and a first secondary chamfered surface 736, and second primary chamfered surface and a second secondary chamfered surface 738. The dual chamfered surfaces disrupt the continuity of the cutting edge.

It is important to note that although FIGS. 7A, 7B, and 7C depict the additional chamfered surfaces 736, 738 as being connected to side flats 716, the additional chamfered surfaces are not limited to being formed at these locations. In some embodiments, the additional chamfered surfaces are connected adjacent to the second chamfer surface 718, being formed at bevel angles (not shown) relative to the front cutting face 708, and offset or misaligned relative to the side flat 716 or the cutting apex 720. For example, the second chamfer surface 718 may appear to be segmented, having an initial chamfer at a first bevel angle and a secondary chamfer directly adjacent to the initial chamfer at a second bevel angle. The bevel angles are formed relative to the front cutting face 708 or the cutting apex 720, such that the initial chamfer may be aligned with the cutting apex 720 and have an angle ranging, for example, from 5° to 25° relative to the front cutting face 708, with a 2° to 10° variance; while the secondary chamfer (i.e., of the segmented second chamfer surface 718) is offset or skewed relative to the cutting apex 720 and has an angle that may range from 10° to 35° relative to the front cutting face, with a 2° to 10° variance. In other embodiments, the angles of the initial bevel and the secondary bevel are the same, while the bevels are formed at different locations. For example, the initial chamfer may have a bevel formed at a first arc segment aligned with the cutting apex 720, while the secondary chamfer may have a bevel formed at a second arc segment that is offset or misaligned relative to the cutting apex 720. Although the segmented second chamfer surface 718 is discussed relative to two bevels, it is noted that the segmented second chamfer surface 718 may include three, four or more bevels. In some embodiments, the bevel angles of the segmented second chamfer surface 718 are tailored, chosen, varied, or further optimized to reduce loads exerted on the cutting apex by angling the planes existing at the cutting apex relative to subterranean formations or to account for stressful conditions. In other embodiments, the surface area of the planes adjacent to at the cutting apex (i.e., as formed by the additional chamfer surfaces) are optimized according to respective stressful conditions, drilling applications, drill-bit or drilling body type, real-time parameters, resultant parameters, and combinations thereof. Although cutting element 700 is described as having a segmented second chamfer surface 718, any of the cutting elements 300, 400, 500, 600, 700, 800 (below), and 900 (below) may be formed to include a segmented second chamfer surface.

The front cutting face 708 includes a recessed surface 737 having a depth 740 relative to the front cutting face 708 and the depth or length of the total PDC cutting volume 704. The depth 740 may range from about 2% to about 50% of the depth of the PDC cutting volume 704. In some embodiments, the depth 740 may range from about 5% to about 30% of the depth of the PDC cutting volume 704. In other embodiments, the depth 740 may range from about 10% to about 20% of the depth of the PDC cutting volume 704. For example, the PDC cutting volume may be formed to extend from 1.0 to 5.0 mm in depth beneath the front cutting face 708, while the recessed surface 737 extends from 0.4 to 2.0 mm beneath the front cutting face 708. In some embodiments, the PDC cutting volume extends from 1.5 to 4.5 mm in depth beneath the front cutting face 708, while the recessed surface 737 extends from 0.1 to 1.3 mm beneath the front cutting face 708. In other embodiments, the PDC cutting volume extends from 2.0 to 4.0 mm in depth beneath the front cutting face 708, while the recessed surface 737 extends from 0.2 to 1.0 mm beneath the front cutting face 708.

The recessed surface 737 may be formed at or near a geometrical center of the front cutting face 708. In some embodiments, the recessed surface 737 includes at least two transition surfaces 742 and 744.

In other embodiments, the recessed surface 737 includes a first transition surface 742, a second transition surface 744, a third transition surface 746, and a fourth transition surface 748. The cutting apex 720 is in lateral alignment with the third transition surface 746, which curves about an angle. The curved angle of the third transition surface 746 ranges from about 80° to 100°, with a 2° to 10° variance, relative to a midpoint of the recessed surface 737, which is laterally aligned with cutting apex 720. In some embodiments, the third transition surface 746 curves about an angle ranging from 84° to 96°, relative to a midpoint of the recessed surface. In other embodiments, the third transition surface 746 curves about an angle ranging from 82° to 92°, relative to a midpoint of the recessed surface.

The third transition surface 746, is positioned between, or intersects, the first transition surface 742 and the second transition surface 744. Positioned opposite the third transition surface 746 is the fourth transition surface 748, which is also non-linear. At least one of the transition surfaces 742, 744, 746, and 748 includes dual chamfered surfaces, sloping or tapering down to the depth 740 of the recessed surface 737. In other embodiments, one or more of the transition surfaces 742, 744, 746, and 748 is not chamfered. At least one of the transition surfaces 742 and 744 is linear, being substantially parallel with an edge of a side flat 716, while one or more of the transition surfaces 746 and 748 is non-linear. However, various other combinations of linear and non-linear transition surfaces are contemplated and included herein. For example, each of transition surfaces 742 and 744 may be non-linear, or curved to better approximate a flow of plastic, or semi-plastic, rock fragments that occurs during drilling.

FIGS. 8A, 8B, and 8C illustrate perspective, face, and side views, respectively, of an embodiment of a PDC cutting element 800 in accordance with the present disclosure. The PDC cutting element 800 includes a discontinuous cutting edge formed having multiple cutting apexes 820*a*, 820*b*, 820*c*, and 820*d* in the PDC volume 804. The discontinuous cutting edge includes multiple cutting apexes 820, such that when significant wear has worn down one apex 820*a* of the PDC cutting element 800, the PDC cutting element 800 may be rotated by removing the drill bit, and by removing, rotating, and reattaching the PDC cutting element 800 on the drill bit in order to orient the other cutting apex 820*b*, 820*c*, or 820*d* towards the formation material to be drilled. The cutting face 808 includes a first formation line 850, a second formation line 852, a third formation line 854, and a fourth formation line 856. Although each of the formation lines 850, 852, 854, and 856 are depicted as being linear, other formations are contemplated and included herein. For example, one or more, or all, of the formation lines 850, 852, 854, and 856 may be non-linear.

Two side flat surfaces from each of the two pairs of dual side flats 816 are separated by respective angles that range from about 80° to 100°, with a 2° to 10° variance, relative to a midpoint of a respective cutting apex. In some embodiments, the separation angles range from 84° to 96°, relative to the midpoint of the respective cutting apex. In other embodiments, the separation angles range from 82° to 92°, relative to the midpoint of the respective cutting apex. The respective apexes include cutting apexes 820*a*, 820*b*, 820*c*, or 820*d* between a pair of dual side flats. For example, side flat 816*a* may be separated from the side flat 816*h* by 90 degrees, wherein 816*a* and 816*b* form a pair of side flats and 816*g* and 816*h* form a second pair of side flats. The angle of the planes of formation of each side flats 816*a*, 816*b*, 816*c*, 816*d*, 816*e*, 816*f*, 816*g*, 816*h*, respectively may range from 1° to 15°, with a 2° to 10° variance, relative to the midpoint formation line and a tangent line of the side flat. In some embodiments, the angle of each plane respectively may range from 1° to 15°, with a 2° to 10° variance, relative to the midpoint formation line and a tangent line of the side flat. In some embodiments, the angle of each plane may range from 2° to 10° relative to the midpoint formation line and the tangent line of the side flat. In other embodiments, the angle of each plane of formation of side flats 816*a*, 816*b*, 816*c*, 816*d*, 816*e*, 816*f*, 816*g*, 816*h* ranges from 3° to 7° relative to the midpoint formation line and the tangent line.

It is noted that to avoid repetition, not all features (e.g., structures, materials, regions, devices) shown in FIGS. 3A-8C are described in detail herein. Rather, unless described otherwise above, in FIGS. 4A-8C, a feature designated by a reference numeral that is a 100 increment of the reference numeral of a feature previously described with reference to FIGS. 3A-3C will be understood to be substantially similar to the previously described feature except in a manner indicated or shown otherwise. By way of non-limiting example, unless described otherwise above, features designated by the reference numerals 410, 510, 610, 710, 810, in FIGS. 4A-8C will be understood to be substantially similar to the interface 310 previously described herein with reference to FIGS. 3A-3C. Similarly, features designated by a reference numeral that is a 100 increment of reference numerals initially described with reference to FIGS. 4A-8C and shown in others of the FIGS. 4A-8C will be understood to be substantially similar to the previously described feature except in a manner indicated or shown otherwise.

In some embodiments, the PDC volumes include diamond-containing material formed of and including diamond-containing agglomerates as described in U.S. Patent Publication No. US2021/0245244A1 (to Robertson), the disclosure of which is hereby incorporated herein by this reference in their entirety. Precursor diamond-containing agglomerates may include discrete diamond particles intermixed with a binder material and/or a wax material (e.g., paraffin wax or polyethylene glycol (PEG)). The precursor diamond-containing agglomerates may be sintered while exposing the precursor diamond-containing agglomerates to a quantity of catalyst material to form diamond-containing agglomerates. The diamond-containing agglomerates may include discrete quantities of polycrystalline and/or superabrasive material while inhibiting formation of inter-granular bonds among the agglomerates themselves. In some embodiments, the diamond-containing agglomerates may contain catalytic, non-advantageous metallic compounds or metallic phases (e.g., catalytic cobalt, catalytic iron, catalytic nickel). For example, the non-advantageous metallic compounds or metallic phases may not be leached from the diamond-containing agglomerates (e.g., "non-leached" diamond-containing agglomerates). In additional embodiments, the diamond-containing agglomerates may be at least substantially free of the non-advantageous metallic compounds or metallic phases. For example, the non-advantageous metallic compounds or metallic phases may be leached from the diamond-containing agglomerates (e.g., "leached" diamond-containing agglomerates).

Figure 9:
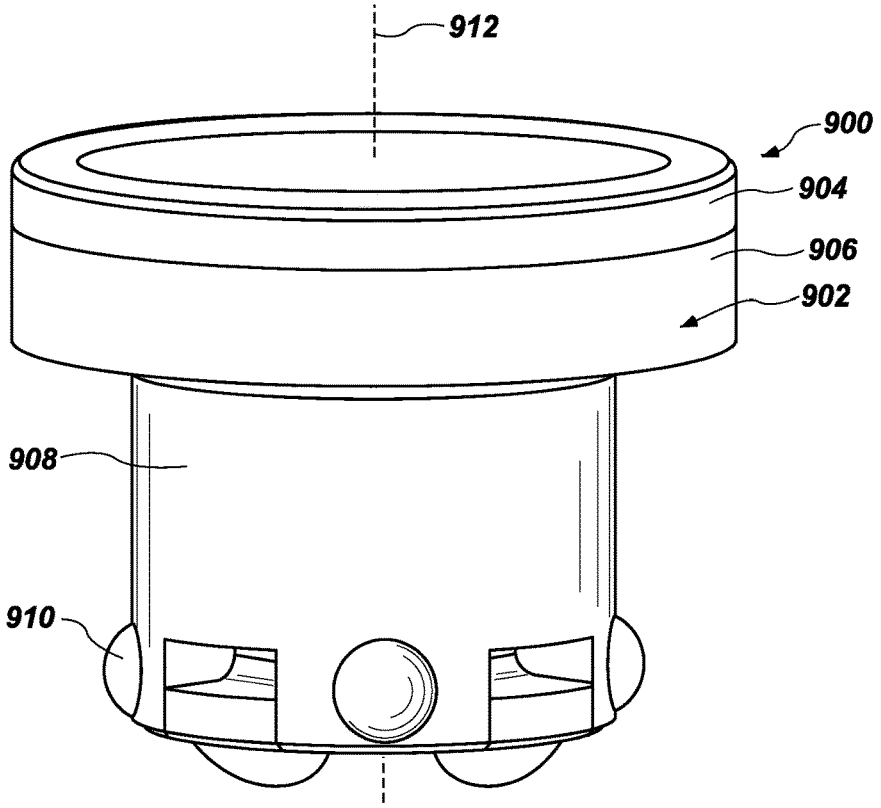
FIG. 9 illustrates a perspective view of a rotatable and removable cutting element of a mountable cutting element assembly in accordance with the present disclosure.

FIG. 9 is a perspective view of a cutting element assembly 900. The cutting element assembly 900 includes a rotatable and removable cutting element 902. The cutting element 902 includes a PDC volume 904, a substrate 906, and an insertion base 908. The insertion base 908 includes one or more locking features 910, such as a detent, a retention element, a keying protrusion, a ball bearing, or combinations thereof. As is discussed in greater detail in U.S. Pat. No. 10,724,304, titled CUTTING ELEMENT ASSEMBLIES AND DOWNHOLE TOOLS COMPRISING ROTATABLE AND REMOVABLE CUTTING ELEMENTS AND RELATED METHODS, by John Abhishek Raj Bomidi, et al., the disclosure of which is incorporated herein by this reference in its entirety, the cutting element 902 may be rotatably removable from within a sleeve secured to a body portion of an earth-boring tool, without utilizing heat. As a result, the cutting element 902 herein may be relatively easily removed and replaced, such as when the cutting element is worn or damaged. The base of the substrate 906 is rigidly secured to the insertion base 908, for example, as with a cementing or brazing process.

Figure 10:
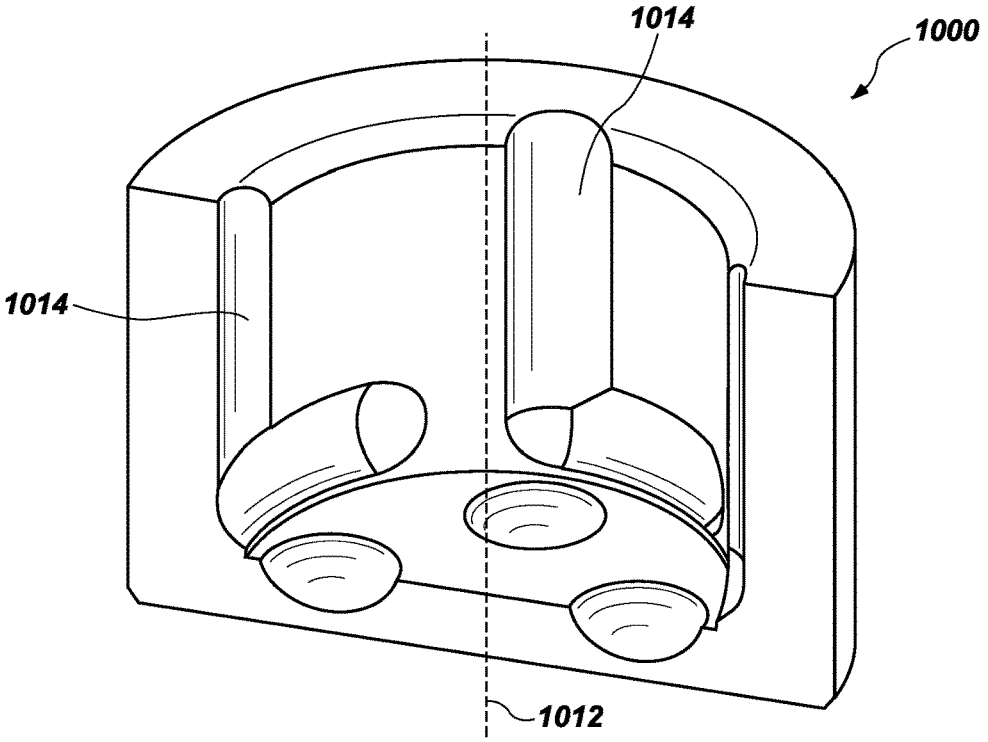
FIG. 10 illustrates a perspective, cross-sectional view of a sleeve of a mountable cutting element assembly in accordance with the present disclosure.

FIG. 10 is a perspective cross-sectional view of a sleeve 1000 of the cutting element assembly 900. In some embodiments, the sleeve 1000 may be mounted to a body portion, such as a blade, of an earth-boring tool. The blade may be, for example, one of the blades 1116 shown in FIG. 11, below. In other embodiments, the cutting element 902 may be inserted into a cutting element pocket or socket of the blade, without use of the sleeve 1000. Referring to FIGS. 9 and 10 together, the cutting element 902 may be at least partially disposed within the sleeve 1000, aligning axis 912 with axis 1012, and having the one or more locking features 910 within one or more L-shaped or J-shaped slots 1014. The cutting element 902 may be removably secured to the sleeve 1000 using the locking features 910 and the slots 1014, and as discussed above, the sleeve 1000 may be secured to the blade. For example, the sleeve 1000 may be brazed or welded within a pocket of the blade. In other embodiments, the sleeve 1000 may be integrally formed with the blade, such that there is no physical interface between the sleeve 1000 and the blade. In other words, the blade may be formed to include the features of the sleeve 1000. Further, the sleeve 1000 may comprise a preformed component that is secured to the blade during formation of the blade and body from which the blade may protrude, by insertion of the sleeve 1000 into a mold cavity wherein the body and blade are formed as by infiltration of matrix material, or by casting. Although FIGS. 9 and 10 discuss cutting element assembly 900 as incorporating the cutting element 902 as a removable cutting element, it is important to note that any one of cutting elements 300, 400, 500, 600, 700, and 800 may be configured as a removable cutting element. Additionally, although FIG. 9 depicts cutting element 902 without certain features discussed above, such as dual chamfered edges, side flats, or a cutting apex, this is for ease of illustration, as cutting element 902 may have any or all of the features discussed above relative to cutting elements.

Figure 11:
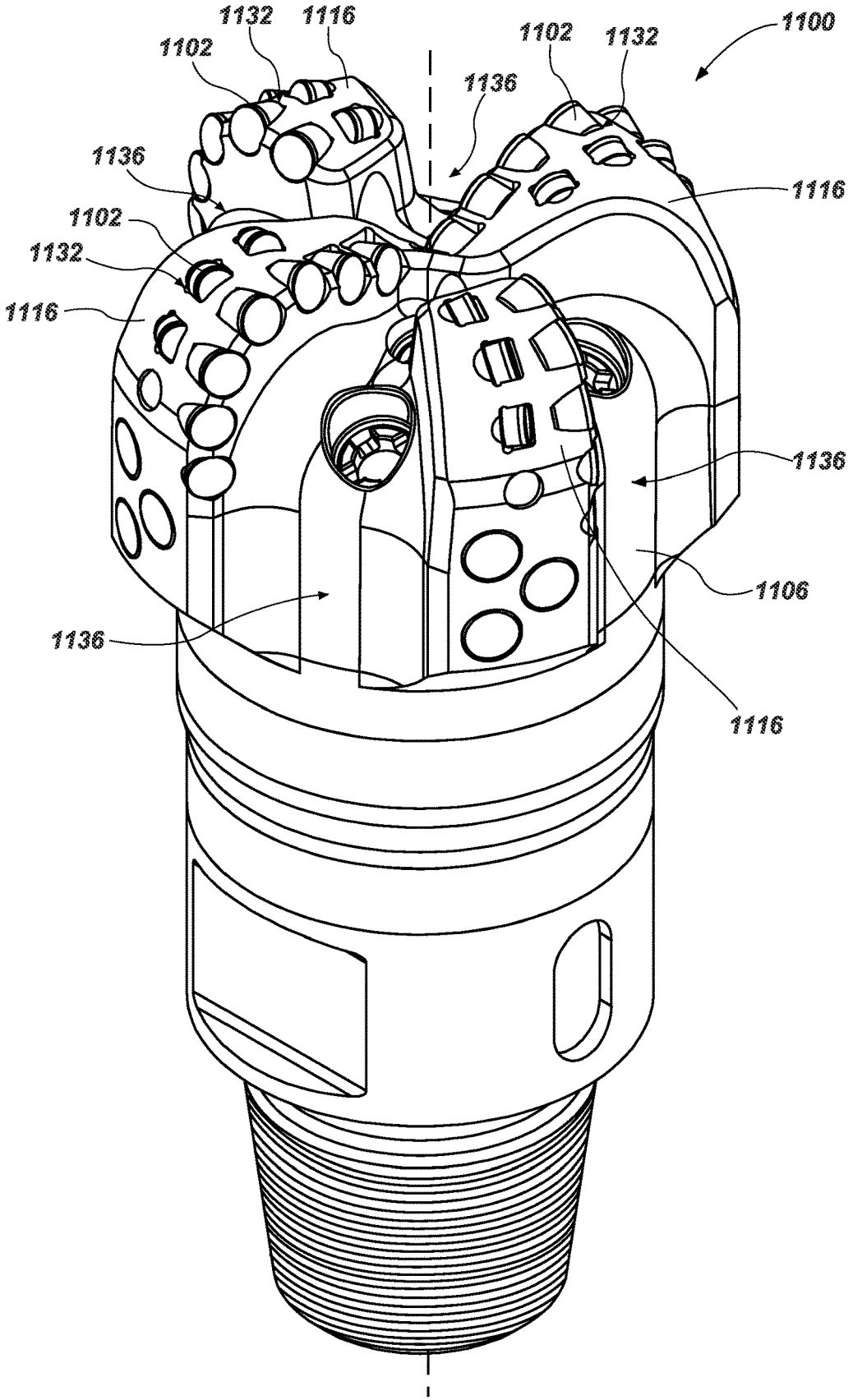
FIG. 11 illustrates a perspective view of an earth-boring tool including one or more cutting elements in accordance with the present disclosure.

FIG. 11 is a perspective view of an earth-boring tool 1100 including one or more cutting elements 1102, which may be configured for use with any of the embodiments shown in connection with FIGS. 3A through 8C, or any possible combination of their features, as described above. For the sake of simplicity, the cutting elements 1102 have been illustrated as having planar cutting faces, but at least one of the cutting element 1102, up to all of the cutting elements 1102, may have the complex geometries described above. The earth-boring tool 1100 may include a body 1106 to which the cutting element(s) 1102 may be secured. The earth-boring tool 1100 specifically depicted in FIG. 11 is configured as a fixed-cutter earth-boring drill bit, including blades 1116 projecting outward from a remainder of the body 1106 and defining junk slots 1136 between rotationally adjacent blades 1116. In such an embodiment, the cutting element(s) 1102 may be secured partially within pockets 1132 extending into one or more of the blades 1116 (e.g., proximate the rotationally leading portions of the blades 1116 as primary cutting elements 1102, rotationally following those portions as backup cutting elements 1102, or both). However, cutting elements 1102 as described herein may be bonded to and used on other types of earth-boring tools, including, for example, roller cone drill bits, percussion bits, core bits, eccentric bits, bi-center bits, reamers, expandable reamers, mills, hybrid bits, and other drilling bits and tools known in the art.

Those skilled in the art, however, will appreciate that the size, shape, and/or configuration of the bit may vary according to operational design parameters without departing from the spirit of the present invention. Further, the invention may be practiced on non-rotary drill bits, the invention having applicability to any drilling-related structure including percussion, impact or "hammer" bits.

Figure 12:
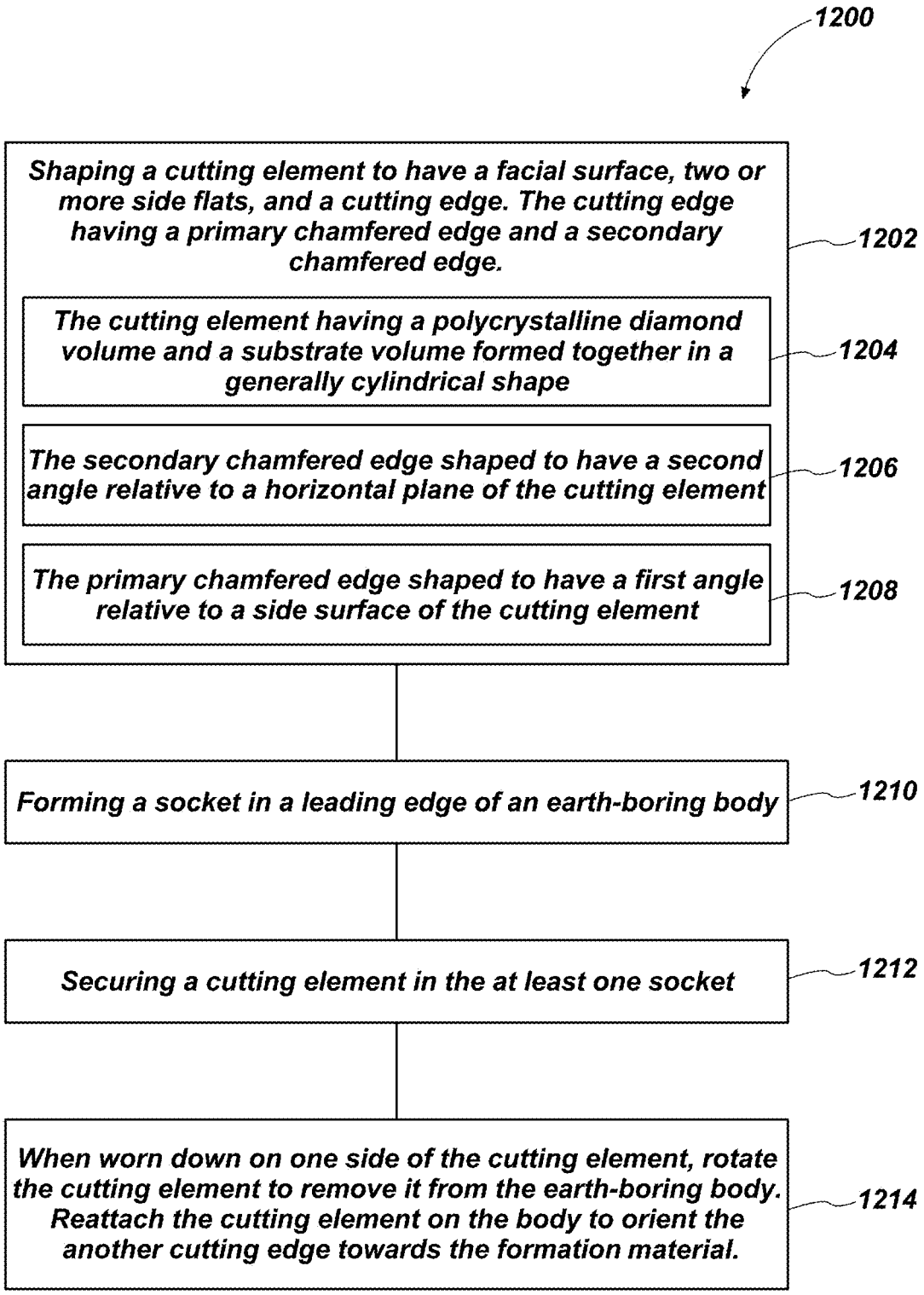
FIG. 12 illustrates a method of forming an earth-boring tool in accordance with the present disclosure.

FIG. 12 depicts a method 1200 of forming an earth-boring tool in accordance with the present disclosure. The method may include forming an earth-boring body for a drilling application, such as forming a borehole in a subterranean formation. The earth-boring body may include but is not limited to, a drill-bit body, a reamer body, a gauge pad, a pilot bit, and combinations thereof.

Step 1202 may include forming and shaping a cutting element to have a facial surface, two or more side flats, and a cutting edge. The cutting edge has a primary chamfered edge and a secondary chamfered edge.

Step 1202 may include intermediary steps 1204, 1206, and 1208. For example, when the cutting element is formed and/or shaped, the process of formation may include Step 1204, which may include forming a PDC volume and a substrate together in a generally cylindrical shape. This may include subjecting the volumes to an HTHP process.

Step 1206 may include forming a secondary chamfered edge in the PDC volume. For example, the side flats of the cutting element may be formed first in the cutting element by machining, grinding, or laser technologies; and then, the secondary chamfered edge may be formed. However, in some embodiments, the secondary chamfered edge may be formed before the side flats are formed in the cutting element. The secondary chamfered edge may be formed having an angle relative to a horizontal plane, a side surface, or an axis of the cutting element. In embodiments, the secondary chamfered edge may be formed having an angle relative to the side surface, or an axis that is parallel to the side surface, of the cutting element.

Step 1208 may include forming a primary chamfered edge in the PDC volume. For example, the side flats and the secondary chamfered edge of the cutting element may be formed first; and then, the primary chamfered edge may be formed in the cutting element by machining, grinding, or laser technologies. The primary chamfered edge may be formed having an angle relative to a horizontal plane, a side surface, or an axis of the cutting element. The primary chamfered edge may be formed having an angle relative to a horizontal plane that is parallel with the cutting face of the cutting element.

Step 1210 may include forming one or more sockets in the leading edge of the boring body. For example, a drill bit may include a blade that has a leading edge. Multiple sockets may be formed in an axial direction along the blade such that the cutting edges of multiple cutting elements may be oriented towards the formation to be drilled. It is important to note that while embodiments include forming a socket, recess, hole or similar formation to receive a cutting element, additional configurations are contemplated and included herein. For example, a cutting element may be directly secured to an earth-boring body without departing from the scope of the present disclosure.

Step 1212 may include securing a cutting element in a socket of the boring body. For example, a cutting element may be cemented, brazed, or otherwise fixed into the socket. In some embodiments, as discussed above, the socket may include a J-slot, such that the cutting element is removably secured within the socket of the boring body.

Step 1214 optionally may include rotatably removing the cutting element from the boring body when an edge, apex, or other feature of the cutting element is worn down on one side. After removal, the cutting element may be rotated such that another side, edge, apex, or non-worn feature faces the subterranean formation to be drilled. The cutting element may be reattached and oriented towards the formation material to be removed.

It will be appreciated by one of ordinary skill in the art that one or more features of any of the illustrated embodiments may be combined with one or more features from another embodiment to form yet another combination within the scope of the invention as described and claimed herein. Thus, while certain representative embodiments and details have been shown for purposes of illustrating the invention, it will be apparent to those skilled in the art that various changes in the invention disclosed herein may be made without departing from the scope of the invention, which is defined in the appended claims.

Additional non-limiting example embodiments of the present disclosure are described below.

Embodiment 1: A cutting element, comprising: a substrate; a volume of polycrystalline diamond (PDC) on the substrate, the volume of PDC having a front cutting face, a lateral side surface, and a cutting edge between the front cutting face and the lateral side surface, the cutting edge having a cutting apex and extending between a first side flat surface and a second side flat surface, the first side flat surface and the second side flat surface disposed on opposing sides of the cutting apex of the cutting edge, the cutting edge further including a first chamfer surface and a second chamfer surface, the first and second chamfer surfaces located adjacent to one another and oriented at a first angle relative to one another at the cutting apex, the cutting edge comprising one of: an arcuate edge having a radius of curvature; and a linear edge having at least two discrete linear edges adjacent one another and separated by a second angle.

Embodiment 2: The cutting element of Embodiment 1, wherein at least one of the first side flat surface and the second side flat surface tapers away from the lateral side surface at a third angle ranging from about 1° to 15° relative to the lateral side surface.

Embodiment 3: The cutting element of any one of Embodiments 1 and 2, in which the first angle ranges from about 35° to 55° relative to the lateral side surface.

Embodiment 4: The cutting element as in any one of the preceding Embodiments, in which the cutting edge comprises the linear edge having at least four discrete linear edges, a first at least two discrete linear edges positioned at the cutting apex and a second at least two discrete linear edges separated from the first at least two discrete linear edges by a side flat surface.

Embodiment 5: The cutting element of any one of the preceding Embodiments, in which the second chamfer surface has an edge extending between the first side flat surface and the second side flat surface with a radial dimension less than the radius of curvature.

Embodiment 6: The cutting element as in any one of the preceding Embodiments, in which at least one of the first side flat surface and the second side flat surface comprises a planar tapered surface that tapers to a midpoint formation line at a fourth angle ranging from about 1° to 15° relative to a tangent line.

Embodiment 7: The cutting element of any one of the preceding Embodiments, further comprising: a recessed surface, the recessed surface being recessed at a depth relative to the front cutting face of the volume of PDC.

Embodiment 8: The cutting element of Embodiment 7, further comprising: a first transition surface; and a second transition surface, wherein at least one of the first and second transition surfaces is oriented parallel to an edge of a side flat surface.

Embodiment 9: The cutting element of Embodiment 8, further comprising: a third transition surface between and intersecting each of the first transition surface and the second transition surface.

Embodiment 10: The cutting element of Embodiment 8, further comprising: an additional chamfer surface connected adjacent to an edge of a side flat surface, wherein the additional chamfer surface is substantially parallel to the edge of the side flat surface.

Embodiment 11: The cutting element of Embodiment 9, further comprising: a fourth transition surface, wherein at least one of the first transition surface, the second transition surface, the third transition surface, and the fourth transition surface is non-linear and tapers from the front cutting face to the depth of the recessed surface.

Embodiment 12: An earth-boring tool, comprising: a boring body; a cutting element secured to the boring body, the cutting element comprising: a substrate having a base and a substrate volume; a volume of polycrystalline diamond (PDC) on the substrate, the volume of PDC having a front cutting face, a lateral side surface, and a cutting edge between the front cutting face and the lateral side surface, the cutting edge having a cutting apex and extending between a first side flat surface and a second side flat surface, the first side flat surface and the second side flat surface disposed on opposing sides of the cutting apex of the cutting edge, the cutting edge oriented at a first angle relative to the lateral side surface, the cutting edge comprising one of: an arcuate edge having a radius of curvature; and a linear edge having at least two discrete linear edges adjacent one another and separated by a second angle; and an interface between the substrate and the volume of PDC, the interface being separated from the base of the substrate by a majority of the substrate volume.

Embodiment 13: The earth-boring tool of Embodiment 12, wherein the substrate volume is substantially cylindrical, the cutting edge comprises the linear edge having the at least two discrete linear edges, and the base has a circumference that circumscribes the at least two discrete linear edges of the cutting edge.

Embodiment 14: The earth-boring tool of any one of Embodiments 12 and 13, further comprising: a plurality of blades extending from one end of the boring body, at least one blade of the plurality of blades comprising a leading edge section oriented towards formation material.

Embodiment 15: The earth-boring tool of any one of the preceding Embodiments, in which the cutting element is removably secured to the boring body.

Embodiment 16: The earth-boring tool of any one of the preceding Embodiments, further comprising: a plurality of cutting apexes; and wherein the plurality of cutting apexes comprises dual chamfer surfaces, and wherein one or more chamfer surfaces of the dual chamfer surfaces are adjacent the first side flat surface and the second side flat surface.

Embodiment 17: A method of manufacturing an earth-boring tool, comprising: forming a boring body; forming at least one socket in a leading edge section of the boring body; forming a cutting element for the at least one socket of the boring body; wherein forming the cutting element comprises: forming a substrate; forming a volume of polycrystalline diamond (PDC) on the substrate; shaping the volume of PDC and the substrate to have two or more side flat surfaces, a front cutting face, and a cutting apex; wherein shaping the volume of PDC and the substrate further comprises: disposing a first side flat surface and a second side flat surface of the two or more side flat surfaces on opposing sides of the cutting apex; forming a cutting edge to extend between the first side flat surface and the second side flat surface and to have a first chamfer surface and a second chamfer surface, the first and second chamfer surfaces located adjacent to one another and oriented at an angle relative to one another at the cutting apex, the cutting edge further formed to comprise one of: an arcuate edge; and a linear edge; wherein an amount of chamfering relative to the first chamfer surface and the second chamfer surface is selectively chosen to distribute a cutting load or to reduce stress placed on the cutting apex; and placing the cutting element in the at least one socket of the boring body.

Embodiment 18: The method of Embodiment 17, wherein shaping the volume of PDC and the substrate further comprises forming the first side flat surface and the second side flat surface before the first and second chamfer surfaces.

Embodiment 19: The method of any one of Embodiments 17 and 18, in which shaping the volume of PDC and the substrate further comprises forming the second chamfer surface before the first chamfer surface is formed.

Embodiment 20: The method of any one of the preceding Embodiments, in which placing the cutting element in the at least one socket of the boring body comprises removably securing the cutting element within a slot or a recess of a cutting element assembly.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A cutting element, comprising:

a substrate;

a volume of polycrystalline diamond (PDC) disposed on the substrate;

a front cutting face located on the volume of PDC;

a lateral side surface extending from the front cutting face;

a first side flat surface and a second side flat surface formed into the lateral side surface and extending to the front cutting face; and a cutting edge comprising a cutting apex extending between the first side flat surface and the second side flat surface, the first side flat surface and the second side flat surface being disposed on opposing sides of the cutting apex of the cutting edge, the cutting edge further comprising a first chamfer surface and a second chamfer surface, the first and second chamfer surfaces located adjacent to one another and oriented at a first angle relative to one another at the cutting apex, the first chamfer surface being interrupted by the first side flat surface and the second side flat surface, the second chamfer surface extending completely around the cutting edge, and the cutting edge comprising one of:

an arcuate edge having a radius of curvature; and a linear edge having at least two discrete linear edges adjacent one another and separated by a second angle.

2. The cutting element of claim 1, wherein at least one of the first side flat surface and the second side flat surface tapers away from the lateral side surface at a third angle ranging from 1° to 15° relative to the lateral side surface.

3. The cutting element of claim 2, wherein the first angle ranges from 35° to 55° relative to the lateral side surface.

4. The cutting element of claim 1, wherein the cutting edge comprises the linear edge having at least four discrete linear edges, a first at least two discrete linear edges positioned at the cutting apex and a second at least two discrete linear edges separated from the first at least two discrete linear edges by a side flat surface.

5. The cutting element of claim 1, wherein the cutting edge comprises the arcuate edge, and wherein the second chamfer surface has an edge extending between the first side flat surface and the second side flat surface with a radial dimension less than the radius of curvature.

6. The cutting element of claim 5, wherein at least one of the first side flat surface and the second side flat surface comprises a first planar tapered surface and a second planar tapered surface that each taper to a midpoint formation line at a fourth angle ranging from 1° to 15° relative to the midpoint formation line.

7. The cutting element of claim 1, further comprising:

a recessed surface, the recessed surface being recessed at a depth relative to the front cutting face of the volume of PDC.

8. The cutting element of claim 7, further comprising:

a first transition surface; and a second transition surface, the first and second transition surfaces extending from the front cutting face to the recessed surface.

9. The cutting element of claim 8, further comprising:

a third transition surface between and intersecting each of the first transition surface and the second transition surface.

10. The cutting element of claim 9, further comprising:

a fourth transition surface, wherein at least one of the first transition surface, the second transition surface, the third transition surface, or the fourth transition surface tapers from the front cutting face to the depth of the recessed surface.

11. An earth-boring tool, comprising:

a boring body;

a cutting element secured to the boring body, the cutting element comprising:

a substrate having a base and a substrate volume;

a volume of polycrystalline diamond (PDC) disposed on the substrate;

a front cutting face disposed on the volume of PDC;

a lateral side surface extending from the front cutting face;

a first side flat surface and a second side flat surface formed into the lateral side surface and extending to the front cutting face, at least one of the first side flat surface or the second side flat surface comprising a first planar tapered surface and a second planar tapered surface that each symmetrically taper about a midpoint formation;

a cutting edge disposed between the front cutting face and the lateral side surface, the cutting edge having a cutting apex extending between the first side flat surface and the second side flat surface, the first side flat surface and the second side flat surface disposed on opposing sides of the cutting apex of the cutting edge, the cutting edge oriented at a first angle relative to the lateral side surface, and the cutting edge comprising one of:

an arcuate edge having a radius of curvature; and a linear edge having at least two discrete linear edges adjacent one another and separated by a second angle; and an interface between the substrate and the volume of PDC, the interface being separated from the base of the substrate by a majority of the substrate volume.

12. The earth-boring tool of claim 11, wherein the substrate volume is cylindrical, the cutting edge comprises the linear edge having the at least two discrete linear edges, and the base has a circumference that circumscribes the at least two discrete linear edges of the cutting edge.

13. The earth-boring tool of claim 12, wherein the cutting element is removably secured to the boring body.

14. The earth-boring tool of claim 11, further comprising:

a plurality of blades extending from one end of the boring body, at least one blade of the plurality of blades comprising a leading edge section oriented towards formation material.

15. The earth-boring tool of claim 11, wherein the cutting element further comprises an additional cutting apex formed on an opposite side of one of the first side flat surface or the second side flat surface from the cutting apex, wherein the cutting apex and the additional cutting apex comprise dual chamfer surfaces, and wherein one or more chamfer surfaces of the dual chamfer surfaces are adjacent the first side flat surface and the second side flat surface.

16. A method of manufacturing an earth-boring tool, comprising:

forming a boring body;

forming at least one socket in a leading edge section of the boring body;

forming a cutting element for the at least one socket of the boring body;

wherein forming the cutting element comprises:

forming a substrate;

forming a volume of polycrystalline diamond (PDC) on the substrate; and shaping the volume of PDC and the substrate to have side flat surfaces, a front cutting face, and cutting apexes;

wherein shaping the volume of PDC and the substrate further comprises:

forming each of the cutting apexes to be between two of the side flat surfaces; and forming cutting edges on the cutting apexes to have a first chamfer surface and a second chamfer surface, the first and second chamfer surfaces located adjacent to one another and oriented at an angle relative to one another at the cutting apexes, the first chamfer surface being interrupted by the side flat surfaces, the second chamfer surface extending completely around the PDC volume, the cutting edges further formed to comprise one of:

an arcuate edge; and a linear edge; and placing the cutting element in the at least one socket of the boring body.

17. The method of claim 16, wherein shaping the volume of PDC and the substrate further comprises forming the side flat surfaces before the first and second chamfer surfaces.

18. The method of claim 16, wherein shaping the volume of PDC and the substrate further comprises forming the second chamfer surface before the first chamfer surface is formed.

19. The method of claim 16, wherein placing the cutting element in the at least one socket of the boring body comprises removably securing the cutting element within a slot or a recess of a cutting element assembly.

* * * * *